United States Patent [19]

Malcolm

[11] Patent Number: 4,522,389

[45] Date of Patent: Jun. 11, 1985

[54] PARTICULATE SURFACE SPORTS TRACK SURFACE AND METHOD FOR RECONDITIONING SUCH TRACK SURFACE

[75] Inventor: John I. Malcolm, Middleton, Nr. Tamworth, England

[73] Assignee: Coinaqua Limited, Warwick, England

[21] Appl. No.: 408,279

[22] Filed: Aug. 16, 1982

[30] Foreign Application Priority Data

Aug. 18, 1981 [GB] United Kingdom ..... 8125136

[51] Int. Cl.[3] ..... A63K 1/02

[52] U.S. Cl. ..... 272/4; 4/491; 405/79

[58] Field of Search ..... 272/3, 4, 5, 17, 18; 4/491, 513; 405/79

[56] References Cited

U.S. PATENT DOCUMENTS

| | | | |
|---|---|---|---|
| 2,836,419 | 5/1958 | White et al. | 272/5 |
| 3,473,334 | 10/1969 | Dexter | 405/79 |
| 3,557,559 | 1/1971 | Barr | 405/79 |
| 3,562,823 | 2/1971 | Koster | 4/491 |
| 3,913,332 | 10/1975 | Forsman | 405/79 |

FOREIGN PATENT DOCUMENTS

| | | | |
|---|---|---|---|
| 551794 | 12/1959 | Belgium . | |
| 465166 | 9/1928 | Fed. Rep. of Germany . | |
| 2312666 | 9/1974 | Fed. Rep. of Germany . | |
| 2627631 | 12/1977 | Fed. Rep. of Germany . | |
| 2901295 | 7/1980 | Fed. Rep. of Germany . | |
| 2387582 | 11/1978 | France | 272/3 |
| 53-28933 | 3/1978 | Japan | 4/491 |

*Primary Examiner*—Richard T. Stouffer

*Attorney, Agent, or Firm*—Cushman, Darby & Cushman

[57] ABSTRACT

A track for sporting activities comprises particulate surfacing having a conditioning system for conditioning the surfacing, and a membrane for recycling liquid passing through the surfacing, the conditioning system comprising a reservoir for liquid which extends along a border of the surfacing adjacent the surfacing, and a wave propagater to cause a surge of liquid to propagate from the reservoir across and through the surfacing, the membrane extending from the reservoir and being arranged to receive liquid passing through the particulate material and to permit the liquid received thereby to pass back into the reservoir.

10 Claims, 3 Drawing Figures

PARTICULATE SURFACE SPORTS TRACK SURFACE AND METHOD FOR RECONDITIONING SUCH TRACK SURFACE

BACKGROUND OF THE INVENTION

This invention relates to a track for sporting activities having a particulate surfacing full stop. The track may be used for activities such as dog racing, horse racing, athletics or even speedway and other motorised sporting activities.

A track usually comprises a surfacing of particulate material, such as sand, light gravel, cinder or shale, to a depth depending on the activity to be performed thereon. The surfacing may have a substrate layer of coarser material than an upper surfacing layer. Such a surfacing will hereinafter be referred to as 'of the kind specified'.

The invention has been devised particularly, but not exclusively, for a dog track. Traditionally, dog tracks were grass surfaced, but to maintain a grass track requires the services of skilled grounds staff. Notwithstanding this, any damage of the track takes a considerable time to repair especially where the track is used frequently. Hence it is difficult to keep such a track in good condition.

For these reasons, in recent years, there has been a decline in the use of grass tracks and most dog tracks are now made of sand or similar particulate material. These can be kept in moderately good condition by raking, rolling and watering and do not need particularly skilled care. By 'good condition' I mean that the surface is flat and compacted. However sand surfaces are readily churned up by the feet of dogs racing at high speed. This means that between races, efforts have to be made to return the track to a suitable condition for further racing. Previously, between races it has been usual for a tractor to circuit the track and to smooth the surface by the use of a rake, roller or screeding blade. The track is also frequently watered which enables the sand to be compacted. Generally, the wetter the material becomes, the better is the surface for dog racing.

This watering may be done either manually using a hose, or semi-automatically using sprinklers. In the latter case, typically the arrangement is that an inside rail of the track is provided with horizontal sprinkler bars supplied with water either directly from the mains or pumped from a supply, the sprinklers being operated when it appears necessary to settle the surface particles of the track, for example to minimise dust thrown up during racing.

Such sprinkler systems have disadvantages, particularly during windy weather because the spray pattern may not cover the track properly.

Very considerable effort is expended on conditioning a track before a race meeting and between races because of the risk of injury to the racing dogs.

In addition to the problems referred to above, none of the water used in conditioning the track has previously been reclaimable. A typical dog track uses many thousands of gallons of water each time the track is conditioned. As water has to be purchased on a commercial basis, this is obviously very expensive. Furthermore, if the use of public water supply for this purpose is prohibited, for example in times of drought, without alternative water supplies, racing may have to be abandoned.

A still further problem is that during the winter, the damp surface of the track may freeze unless it is heated.

A common provision is for the entire surface of a dog track to have underground electric heating elements. Again this is obviously very expensive to install and run.

SUMMARY OF THE INVENTION

It is an object of the present invention to provide a track, which has means to overcome or reduce some or all of these disadvantages.

According to a first aspect of the invention, we provide a track having a particulate surfacing of the kind specified having a conditioning system for conditioning the surface, and means for recycling liquid passing through the particulate material of the surfacing, said conditioning system comprising a reservoir for liquid, adjacent the surfacing, means to cause a surge of liquid to propagate from the reservoir across and through the surfacing, said recycling means including the reservoir, and catchment means disposed to receive liquid passing through the particulate material of the surfacing and to permit the liquid received thereby to pass into the reservoir.

Thus, conditioning of the particulate surfacing is achieved with minimum need for raking or screeding, whilst the track is kept damp. Liquid, which is usually water, used for conditioning the track is also re-usable thus aleviating water costs, once the reservoir has been filled. Any evaporation of the water which may take place will however need to be replenished. Where the particulate surfacing is not under cover, replenishment may take place partly with the assistance of precipitation.

According to a second aspect of the invention, we provide a track having a particulate surfacing of the kind specified having a conditioning system for conditioning the surfacing, said system comprising a reservoir for liquid, adjacent the surfacing, means to cause a surge of liquid to propagate from the reservoir across and through the surfacing.

According to a third aspect of the invention, we provide a particulate surfacing of the kind specified having means for recycling liquid passing through the particulate material of the surfacing, said recycling means comprising a reservoir and catchment means disposed to receive liquid passing through the particulate material and to permit the liquid received thereby to pass into the reservoir.

Preferably, the surge is of low amplitude, that is a wave having sufficient energy to cause surface movement of the particulate material so that a levelling and smoothing of the surfacing takes place, but not so much energy that bulk displacement of the particulate material would occur with consequent damage to the surfacing.

Of course, for different sizes and weights of particulate material, the degree of compaction required and the slope of the surfacing for example, the surge amplitude may differ and thus this needs to be adjustable and selectable by trial, also taking into account the activity for which the particulate surfacing is to be used.

In a preferred embodiment, said means to cause the surge of liquid comprises a wave generating means in the reservoir.

In one embodiment, the wave generating means comprises a paddle reciprocated by a drive means and extending transversely to the direction of wave propagation. Of course, a plurality of such paddles may be provided, or one large paddle.

In another embodiment, the wave generating means comprises a plurality of paddles which are rotated about a common axis by a drive means. For example, a plurality of paddles may be provided by a paddle wheel or the like.

In a still further embodiment of the invention, the wave generating means may comprise a member movable in the reservoir in a direction generally parallel to a side of the surfacing along which the reservoir extends, the movable member having a rudder which, as the member moves, displaces the liquid in the reservoir thus generating a wave of liquid in a direction transverse to the direction of movement of the movable member. Such a member may be movable under its own power, but preferably such member is towed manually or by a drive means.

In a still further embodiment, the surge is generated by means to release a large quantity of liquid quickly from the resevoir, or means to pump the liquid from the reservoir onto the surfacing.

The surfacing may be inclined to the horizontal upwardly and away from the reservoir or cambered, whereby the liquid of the surge is caused to flow at least partly back across and through the surfacing towards the reservoir. It has been found that this return flowing motion assists greatly in levelling of the surface.

The catchment means may comprise a membrane located beneath the upper surface of the particulate surfacing. The depth at which the membrane is located will depend upon various factors including the activity for which the particulate surfacing is to be used, as well as the nature of the particulate material. The membrane may be inclined to the horizontal upwardly and away from the reservoir so that liquid received by the catchment means drains down the membrane back into the reservoir.

To prevent particulate material migrating towards the reservoir, the upper surface of the membrane may have particulate material retaining formations such as projections, in a ribbed pattern extending transversely to the direction of incline of the membrane.

The reservoir may be integral with the catchment means or attached thereto in some watertight manner.

Conveniently, the reservoir comprises a channel extending along a border of the surfacing and the reservoir may be provided with an overflow outlet or outlets should the reservoir become too full, at a level to prevent the surfacing becoming waterlogged.

The reservoir may be provided with a particle trap in a base thereof to collect particulate material which may be washed from the surfacing into the reservoir, for example as a result of the return flow of the liquid.

The particulate surfacing may comprise an annular track for use in racing in which case the reservoir may comprise an annular channel which extends along the inner or outer border of the track.

According to a fourth aspect of the invention, we provide a method of conditioning a particulate surfacing of the kind specified having a reservoir for liquid adjacent thereto, comprising the step of causing a surge of liquid to propagate from the reservoir across and through the surfacing.

According to a fifth aspect of the invention, we provide a method of recycling liquid passing through the particulate material of a particulate surfacing of the kind specified having a catchment means comprising the steps of receiving liquid in the catchment means passing through the particulate material of the surfacing and permitting the liquid received thereby to pass into the reservoir.

BRIEF DESCRIPTION OF THE DRAWINGS

The invention will now be described with the aid of the accompanying drawings, in which.

DESCRIPTION OF THE PREFERRED EMBODIMENTS

Figure 1:
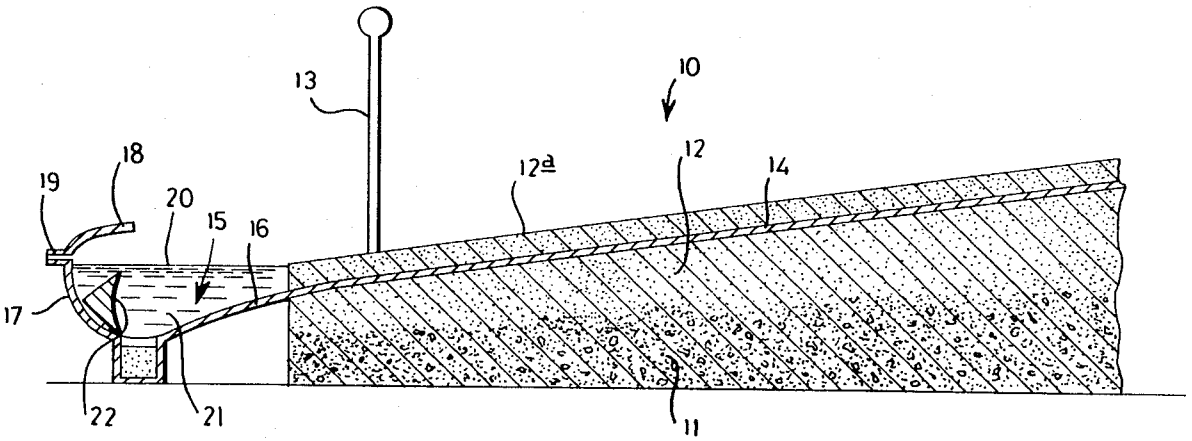
FIG. 1 is a partial vertical section through a portion of a particulate surface comprising a dog track in accordance with the invention.

Referring first to FIG. 1, a section of a particulate surfacing comprising a dog track is generally indicated at 10, and comprises a first lower layer 11 of relatively coarse particulate material, and an upper layer 12 of relatively fine particulate material comprising, in the example shown, sand. Alternatively, instead of sand, the upper layer 12 may comprise fine gravel, cinder or ash or a mixture of any of these, and the lower layer 11 may comprise coarser sand, gravel, cinder or ash or a mixture of these.

The upper layer 12 is preferably 9 inches deep, although this depth may be varied where the particulate surfacing is a horse racing track or a particulate surfacing for a purpose other than dog racing.

The top surface 12*a* of the surfacing 10 is inclined or cambered relative to the horizontal as shown, partly to permit rain water to drain off the top surface and partly in order to assist the dogs running on the track. Thus the top surface 12*a* may be more inclined or cambered around bends for example.

The track is generally elliptical in shape and is more steeply inclined at the ends of the ellipse.

The inner boundary of the track is defined by a guard rail 13.

Beneath the top surface 12*a* of the surfacing 10, a waterproof membrane 14 is provided, which comprises a sheet of thick plastics material which may be rigid or flexible. The membrane 14 is inclined to the horizontal and provides a catchment means for liquid passing through the top surface 12 of the surfacing 11. Any such liquid tends to pass through the particulate material to the waterproof membrane and then drains down the inclined membrane towards the left-hand side as shown in the drawing towards a reservoir.

The reservoir is generally shown at 15 and catches the liquid draining from the membrane 14, the reservoir being formed integrally with the membrane. If desired, of course, the membrane could be joined to the reservoir in a watertight manner or positioned to catch liquid falling from the edge of the membrane 14. Preferably the reservoir is moulded from the same plastics material as the membrane 14 so that there is no joint between the membrane 14 and reservoir 15.

The reservoir takes the form of a channel member which is asymmetrical and includes a shallow sloping wall 16 connected to the membrane 14 adjacent the edge of surface 12, and an opposed wall 17 which, at its upper region 18, is bent so as to overhang the reservoir 15.

Overflow holes 19 are provided at intervals along the reservoir at a level which is sufficiently high to keep the surface 20 of the liquid 21 in the reservoir 15, close to the top surface 12*a* at its innermost border, but which is not so high as to permit the particulate material adjacent the rail 13 to become water-logged.

The overflow holes 19 are preferably formed by drilling when the reservoir 15 has been fixed in position so as to define a suitable level for the surface 20 of the liquid.

Of course, although the reservoir 15 is shown adjacent the inner border of the track 10, if desired the reservoir may be provided adjacent the outer border (not shown) with the membrane 14 inclined in the opposite direction, irrespective of the direction of incline of the upper surface 12*a* of the surfacing.

However, in dog racing at the outer boundary, a hare track is provided around which a hare travels, for the dogs to chase during the race. Thus in dog racing at least, it is preferred for the reservoir 15 to be adjacent the inner border of the track although in other activities, either arrangement may be used.

Located within the reservoir 15 there is disposed a wave generating means 22 which is shown diagrammatically only in FIG. 1, which generates a surge of liquid across and through the surfacing when actuated.

Figure 2:
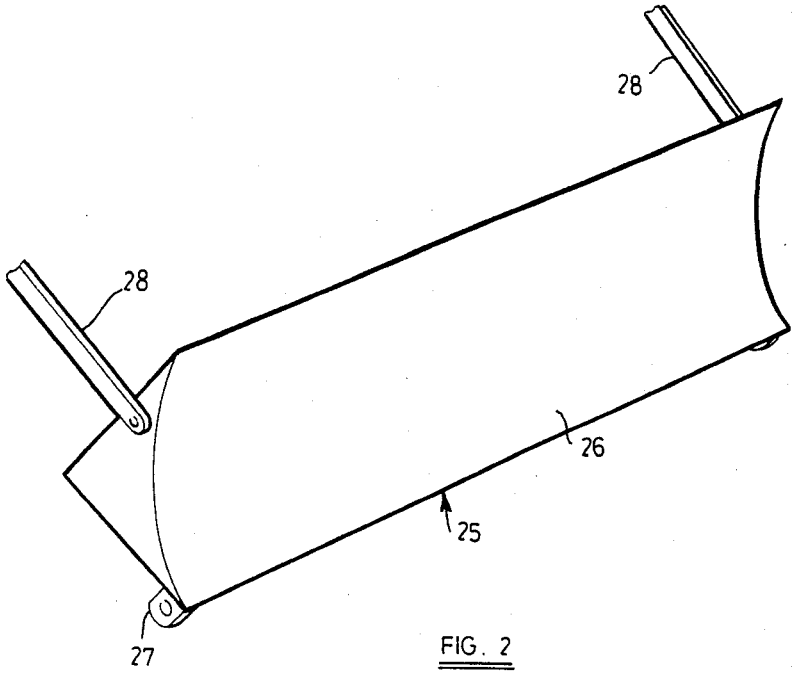
FIG. 2 is one form of surge forming means for use with the particulate surfacing of FIG. 1.

Referring now to FIG. 2, one form of wave generating means is shown comprising a paddle 25 of generally triangular cross-section with a front side 26 generally concave. The paddle 25 is hinged via a hinge 27 to the base of the channel reservoir, and is attached by two pivoted links 28 to a drive means such as a crank shaft (not shown) which translates rotary movement of an engine or motor into reciprocating movement, or to a power piston which provides a direct reciprocating movement. Thus the paddle 25 may be reciprocated in the channel reservoir 15 to provide a surge of liquid.

A plurality of such paddles 25 may be provided along the length of the reservoir or one long paddle as required.

Instead of reciprocating paddles, if desired a plurality of paddles may be adapted to be rotated about a common axis and thus provide a paddle wheel to generate the wave.

Figure 3:
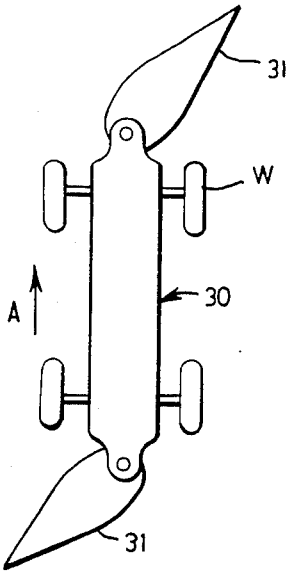
FIG. 3 is an alternative surge forming means for use with the particulate surfacing of FIG. 1.

Referring to FIG. 3, there is shown a further alternative wave generating means comprising a movable member 30 adapted to be moved longitudinally within the channel reservoir 15, for example by towing, or alternatively the member 30 may be provided with its own propulsion means.

The member 30 has a pair of oppositely directed rudders 31 so that as the member 30 moves in the reservoir in direction A, the rudders 31 displace the water thus generating a wave. The rudders 31 are pivoted relative to the remainder of the member 30 to provide for adjustment of the amplitude of surge produced.

The member 30 may be mounted on wheels W as shown which run along the base of the channel, which wheels W may be steerable so that the member 30 can negotiate any bends in the reservoir 15 which may be provided.

In a still further embodiment, the wave generating means may comprise a plunger within the channel, which rapidly displaces liquid thereby generating a wave.

Instead of the surge of liquid being produced by a wave generating means, if desired the surge may be produced by any other means such as, for example, means to permit a large quantity of water to be discharged from the reservoir under gravity onto the surfacing, or by pumping water from the reservoir under pressure onto the surfacing.

If desired, the surge generating means may be provided by a portable unit which is movable from one location on the track to another, where it is desired to condition the track. Alternatively a plurality of surge generating means may be provided around the entire track.

The wave generating means may be mechanically or electrically driven.

In each case, the amplitude of the surge and its speed of propagation will generally be a characteristic of the type of surge generating means used and the speed at which they are operated.

The optimum amplitude of surge can be determined by trial and error depending on the nature of the particulate material of the particulate surfacing 10 and on other characteristics of the surfacing such as its inclination and degree of compaction.

The amplitude of the surge generated may be under the control of an operator who ensures that the travelling wave causes superficial surface movement of the particulate material at top layer 12 of the surfacing so that levelling and smoothing of the surface takes place as the surge propagates across it.

Since the top of the surface 12*a* is inclined, at least part of the liquid contained in the surge will return down the top surface 12 to the reservoir and may again cause superficial surface movement of the particles, in a return flowing motion.

The operator should also ensure that the energy of the surge should not be sufficient to cause bulk displacement of the particulate material which would damage the surfacing 11 and cause an inordinate quantity of the particulate material to be washed into the reservoir. Furthermore, the quantity of liquid in the surge should be arranged not to be excessive, so that the surfacing does not become water-logged.

As the liquid returns towards the reservoir after the surge has propagated across and through the surface, a proportion of the liquid will drain through the top surface onto the waterproof membrane 14 therein, so that the water returns to the reservoir 15. Thus, substantially all the liquid used to form the surge is reclaimed and may thus be re-used.

The reservoir can be maintained full up to the overflow holes 19 at all times by topping up as necessary to compensate for evaporation or, where an outdoor uncovered surface is being conditioned, rain water or other precipitation falling on the surfacing will be collected and will assist in topping up the reservoir 15 as necessary. Thus, it may only be necessary to top up the reservoir from a mains supply at infrequent intervals during rainless periods. Thus only a minimal amount of water needs to be taken from the public supply once the reservoir 15 has been filled to capacity.

The water in the reservoir 15 can be treated by means of suitable additives to provide a liquid having various properties. For example, a pleasant green colouration of the grass track may be simulated by adding a green dye, such as a vegetable dye, to the water. Furthermore, salt or some other form of freezing point depressing or "anti-freeze" material can be added to the water so that underfloor heating elements presently used in protecting the track can be completely dispensed with.

To prevent fungal, bacterial or insect growth taking place in the reclaimed water in the reservoir 15, it is desirable to add fungicide, insecticide and bactericide components to the water, which components must of necessity be harmless to the dogs which will be racing on the track.

The channel section reservoir 15 will be made in lengths, possibly with the waterproof membrane 14 attached to it or integrally formed with it. The lengths will be assembled around the inner periphery of the track and particulate material surfacing laid over the waterproof membrane 14. Any joints will need to be water sealed. When the correct liquid level has been determined, the overflow holes 19 can then be drilled in the wall 17 of the reservoir.

It can be seen that an overhanging region 18 will assist in preventing loss of water from the reservoir during the propagation of the surge.

The reservoir may be divided into sections so that each section can be operated independently of the others to condition a portion of the periphery of the track. On a typical generally elliptical dog racing track, a plurality of straight sections of conditioning system may be provided around the entire boundary of the track.

On an elliptical dog racing track, the relatively sharply curving bends may need to be conditioned more frequently and to a greater extent, during the course of racing than along the straight sections, because of the extra disturbance of the particulate material caused by the dogs running round the sharp bends at high speed.

An operator can ensure that the surge produced at the corners is of greater amplitude and has greater energy than a surge produced along the straights.

It is intended that the conditioning system should be used prior to the start of racing to ensure that the whole surface of the track is in good condition. Between races, as often as required, one or more sections of the track can be conditioned by operating the surge generating means. The surge generating means can be operated from a central control, for example located in the judges' box and in this way it will be no longer necessary to condition the track by the use of tractors dragging rakes, rollers or screed bars across the surface and it will be seen that the propagation of the surge is unlikely to be seriously affected by weather conditions such as windy weather. It will also be seen that the track can be maintained inexpensively in a more or less constant surface condition irrespective of the weather. This contrasts with the present problems encountered in very dry or windy weather when the top surface becomes dry and powdery resulting in a great deal of dust being thrown up during racing.

Although the invention has been particularly described with reference to a dog racing track, the invention may be applied to the conditioning of any other particulate surfacing, such as horse or motor racing tracks.

I claim:

1. A track for sporting activities having an annular inner border and a generally parallel outer border, a particulate surfacing between the inner and outer borders comprising a depth of particulate material, and a conditioning system for conditioning the surfacing, said system comprising a reservoir for liquid having inner and outer annular borders, said reservoir extending alongside one of the borders of the surfacing adjacent the surfacing, and means to cause a surge of liquid to propagate from the reservoir across and through the surfacing, said surge having sufficient energy to cause movement of the particulate material of the surfacing.

2. A track according to claim 1 wherein said surge has insufficient energy to cause bulk displacement of the particulate material.

3. A track according to claim 1 having catchment means disposed beneath the surfacing for receiving liquid passing through the particulate material and for permitting the liquid received thereby to pass into the reservoir.

4. A particulate surfacing according to claim 1 wherein said means to cause the surge of liquid comprises a wave generating means in the reservoir, the wave generating means comprising a paddle reciprocated by a drive means and extending transversely to the direction of wave propagation.

5. A particulate surfacing according to claim 1 wherein said means to cause a surge of liquid comprises a wave generating means in the reservoir, the wave generating means comprises a member movable along the reservoir in a direction generally parallel to the border of the surfacing along which the reservoir extends, the movable member having a rudder which, as the member moves, displaces the liquid in the reservoir thus generating a wave of liquid in a direction transverse to the direction of movement of the movable member.

6. A particulate surfacing according to claim 1, wherein the upper surface of the particulate surfacing is inclined to the horizontal upwardly and away from the reservoir whereby the liquid of the surge is caused to flow at least partly back across and through the surfacing towards the reservoir.

7. A track for sporting activities having an annular inner border and a generally parallel outer border, particulate surfacing between the inner and outer borders comprising a depth of particulate material, and means for recycling liquid passing through the particulate material, said recycling means comprising a reservoir having inner and outer annular borders, said reservoir extending along one of the borders of the surfacing, and catchment means disposed beneath the surfacing to receive liquid passing through the particulate material and to permit the liquid received thereby to pass into the reservoir.

8. A particulate surfacing according to claim 7 wherein said catchment means comprises a membrane beneath the upper surface of the particulate surfacing, which membrane is inclined to the horizontal upwardly and away from the reservoir so that liquid received by the catchment means drains down the membrane back into the reservoir.

9. A particulate surfacing according to claim 1 or claim 7 wherein the reservoir comprises a channel extending along a border of the surfacing, and the reservoir is provided with at least one overflow outlet at a level to prevent the surfacing becoming waterlogged.

10. A method of conditioning a particulate surfacing of a track comprising the steps of:

providing a track for sporting activities having an annular inner border and a generally parallel outer border, a particulate surfacing between the inner and outer borders comprising a depth of particulate matter, and a conditioning system for conditioning the surface, said system including a reservoir for liquid having first and second annular borders, said first border of said reservoir extending alongside one of the borders of the surfacing adjacent the surfacing; and causing a surge of liquid to propagate from the reservoir, over said first border and across and through the surfacing to move particulate matter of the surfacing in any selected portion of the entire track.

* * * * *